United States Patent [19]

Cho

[11] Patent Number: 5,056,333

[45] Date of Patent: Oct. 15, 1991

[54] AIR CONDITIONER WITH VENTILATING MEANS

[75] Inventor: Jun-Kuk Cho, Kyunggi, Rep. of Korea

[73] Assignee: Samsung Electronics Co., Ltd., Suwon, Rep. of Korea

[21] Appl. No.: 624,223

[22] Filed: Dec. 7, 1990

[30] Foreign Application Priority Data

Dec. 9, 1989 [KR] Rep. of Korea ..... 89-18672

[51] Int. Cl.[5] ..... F25D 23/12

[52] U.S. Cl. ..... 62/262; 62/427

[58] Field of Search ..... 62/262, 263, 427, 410; 415/148

[56] References Cited

U.S. PATENT DOCUMENTS 4,553,404 11/1985 Malchow et al. ..... 62/262

4,553,405 11/1985 Napolitano et al. ..... 62/262

*Primary Examiner*—Lloyd L. King

*Attorney, Agent, or Firm*—Cushman, Darby & Cushman

[57] ABSTRACT

In an air conditioner with ventilating means having a port provided at a partition wall dividing a bulkhead of the air conditioner into the inside and outside sections, and a blower for recirculating the indoor air. The ventilating means according to the invention comprise throttle means provided at the port to selectively opening the port by halves and close the port entirely; air introducing means provided at the throttle means for directing the recirculated indoor air stream to flow against thereby causing the outdoor air to be introduced from the port; and adjusting means connected to the throttle means to selectively position the throttle means between the open and close positions.

4 Claims, 3 Drawing Sheets

AIR CONDITIONER WITH VENTILATING MEANS

FIELD OF THE INVENTION

This invention relates to an air conditioner and more particularly to an air conditioner with ventilating means for selectively providing a fresh outdoor air to a space to be conditioned and exhausting a proportion of recirculated indoor air.

BACKGROUND OF THE INVENTION

Generally, an air conditioner has a throttle which may open and close the ports in a bulkhead of the air conditioner for exhausting a portion of indoor air blown by a blower. However, such air conditioners have a drawback that they can exhaust a proportion of recirculated indoor air but introduce little fresh outdoor air.

An improvement over the conventional air conditioner is disclosed in U.S. Pat. No. 4,553,404 to MALCHOW et al. wherein an air conditioner is provided with fresh air circulation means having a throttle which is selectively movable within a dual inlet air conditioner blower wheel between the inlets to control the volume of air flowing through the inlets and the proportions of indoor and outdoor air admitted. The air mixture is presented to the blower wheel and contrifugally propelled through an outlet to the space to be conditioned.

This structure is complicated and furthermore is not successful since the air conditioner can introduce the fresh outdoor air to the indoor air but cannot exhaust the recirculated indoor air from the air conditioner.

SUMMARY OF THE INVENTION

Accordingly, the object of the invention is to provide an improved air ventilating structure capable of selectively introducing fresh outdoor air to the air flowing into the room as well as exhausting a proportion of recirculated indoor air.

In order to accomplish the aforementioned object of this invention, an air conditioner with ventilating means is provided having inside and outside compartments devided by a partition wall in the bulkhead of the air conditioner, said outside compartment communicating with the fresh outdoor ambient air while said inside compartment being provided for recirculated air stream blown by blower, said ventilating means comprising throttle means provided at a port formed in the partition wall for selectively opening and closing a half of the port; fresh air introducing means provided at the throttle means keeping apart from the partition wall for directing the recirculated indoor air stream to flow against it thereby causing the fresh outdoor air to be introduced through the port by the differenced between the pressures of the stream of recirculated indoor air and the outdoor air; and an adjusting means connected to the throttle means for selectively locating the throttle means between the opened position and closed position.

BRIEF DESCRIPTION OF THE DRAWINGS

The above and other related objects and features of the invention will be apparent in the following description and the accompanying drawings in which:

FIGS. 3A–3C show the operations of the ventilating means in FIG. 1., of which:

FIG. 3A is a cross section view of the ventilating means in entirely closed position;

FIG. 3B is a cross section view of the ventilating means positioned for exhausting a proportion of the recirculated indoor air;

FIG. 3C is a cross section view of the ventilating means positioned for introducing the fresh outdoor air.

DETAILED DESCRIPTION OF THE PREFERRED EMBODIMENT

Figure 1:
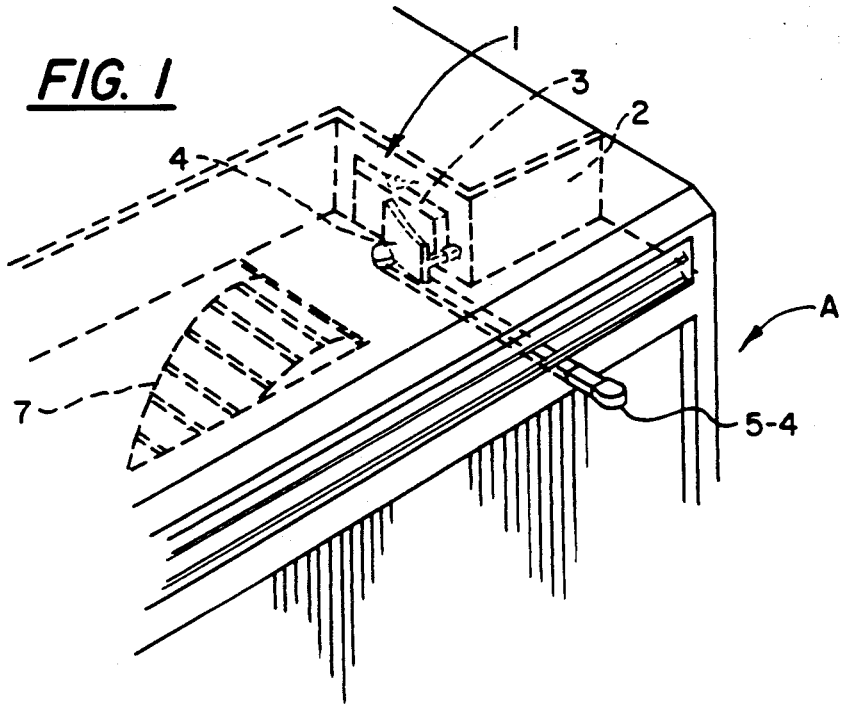
FIG. 1 is a perspective view showing the ventilating means in according to the present invention.
Figure 2:
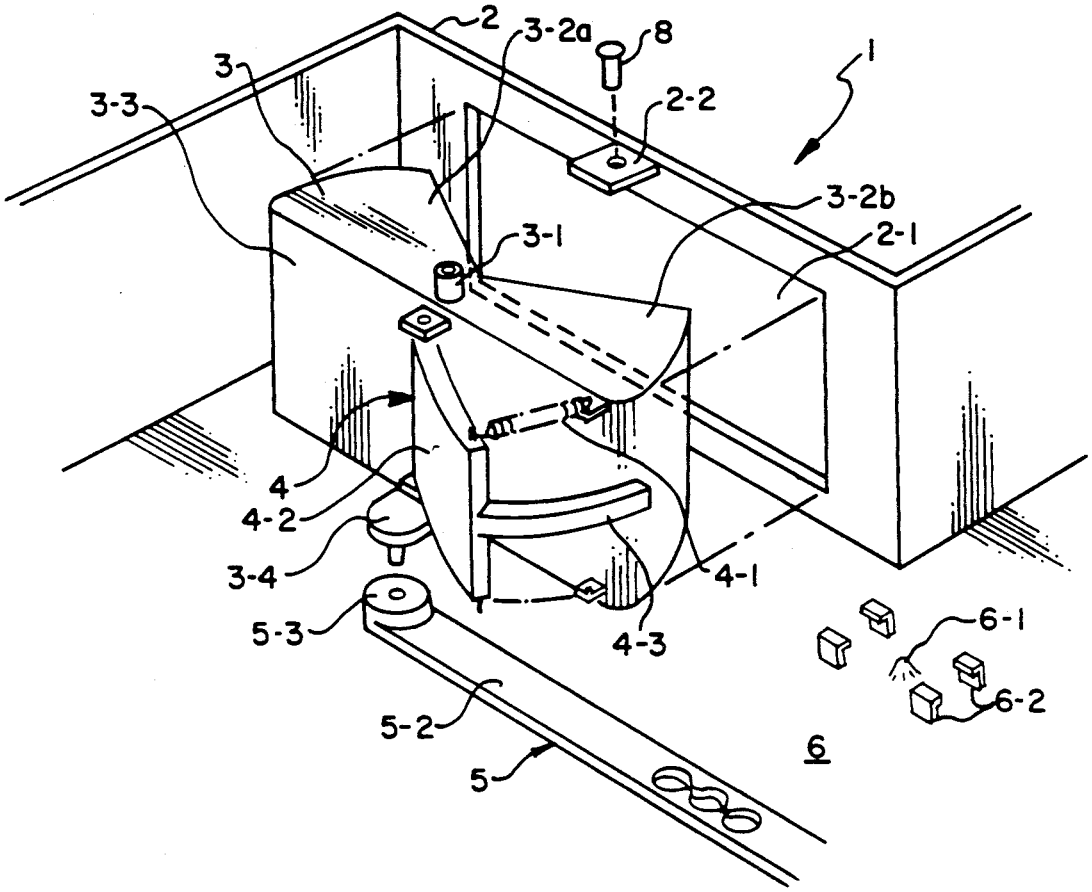
FIG. 2 is an exploded view of the ventilating means in FIG. 1.

Referring to FIGS. 1 and 2, the reference numeral A designates an air conditioner while the reference numeral 1 designates a ventilating means according to the present invention. Said ventilating means 1 comprises a throttling member 3 for opening and closing the port 2-1 and an adjusting member 5 which actuates said throttle member 3 to move between three positions, i.e., a first position opening one half of a port 2-1 to exhausting a proportion of the recirculated indoor air, a second position opening the other half of the port to introduce the fresh outdoor air and a third position entirely closing the port. Said throttling member 3 is provided at a port 2-1 formed in a partition wall 2 dividing the bulkhead of the air conditioner A into two sections of which one is for recirculating of indoor air and the other communicates with the outdoor ambient air.

Also, said throttling member 3 comprises a body 3-3 consisting of two parts 3-2*a* and 3-2*b* for opening the port by half or closing it entirely, cylindrical pins 3-1 provided at a center portion of each of the bottom and top surfaces of the body 3-3 and a segment 3-4 formed at the lower end of the body 3-3 for connecting the adjusting member 5 to the body. And, said pins 3-1 accept studs 8 through an aperture of the segments 2-2 which are formed at the partition wall 2 corresponding to the pins 3-1, respectively thereby permitting the body 3-3 to pivotally move.

Furthermore, the throttling member 3 is provided with an outdoor air introducing member 4 comprising a plate 4-2 and a spacer 4-3 which is integrally formed at one end portion of the plate 4-2 to space out the partition wall 2. The one end portion of the plate 4-2 is also provided with resilient members 4-1 and the other end portion is pivotally connected to the body 3-3.

Said adjusting member 5 comprises a sliding member 5-2 guided by guide members 6-2 which are formed at the bottom plate of the inside section. One end portion 5-3 of the sliding member 5-2 has a projection with a hole to accept a stud formed downward to the segment 3-4, recesses 5-1 formed at the middle portion thereof, the one of said recesses 5-1 which are connected in a line accepting a projection 6-1 according to the selected position of the throttling member 3 and a grip 5-4 at the free end thereof which is extended from the front of the air conditioner. Reference numeral 7 in the drawings designates a blower.

Figure 3B:
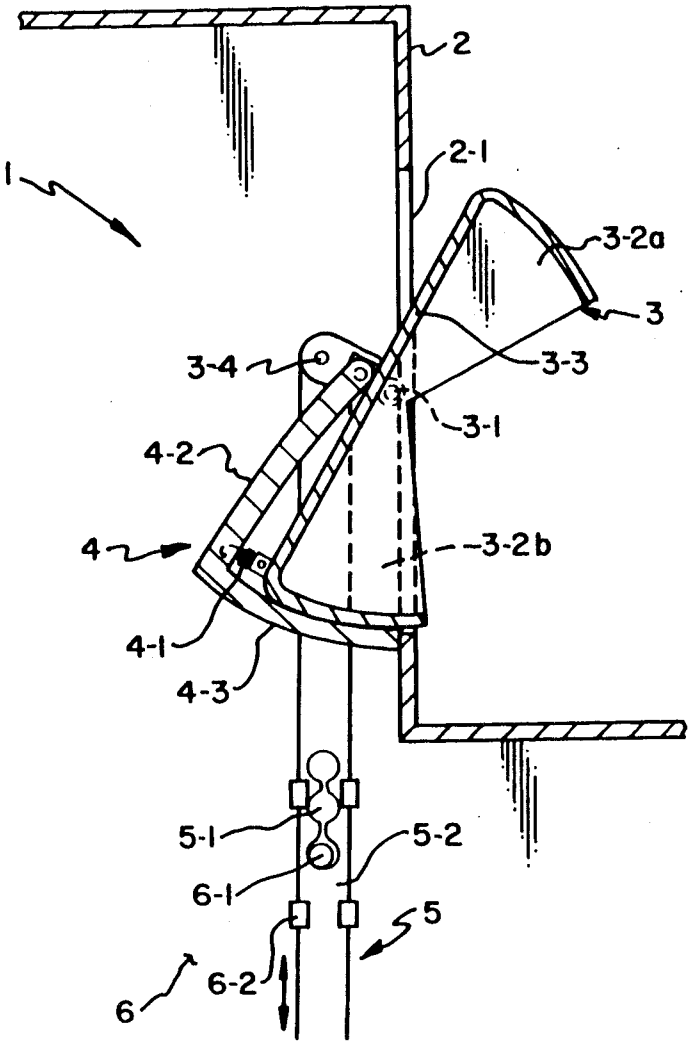
Figure 3A:
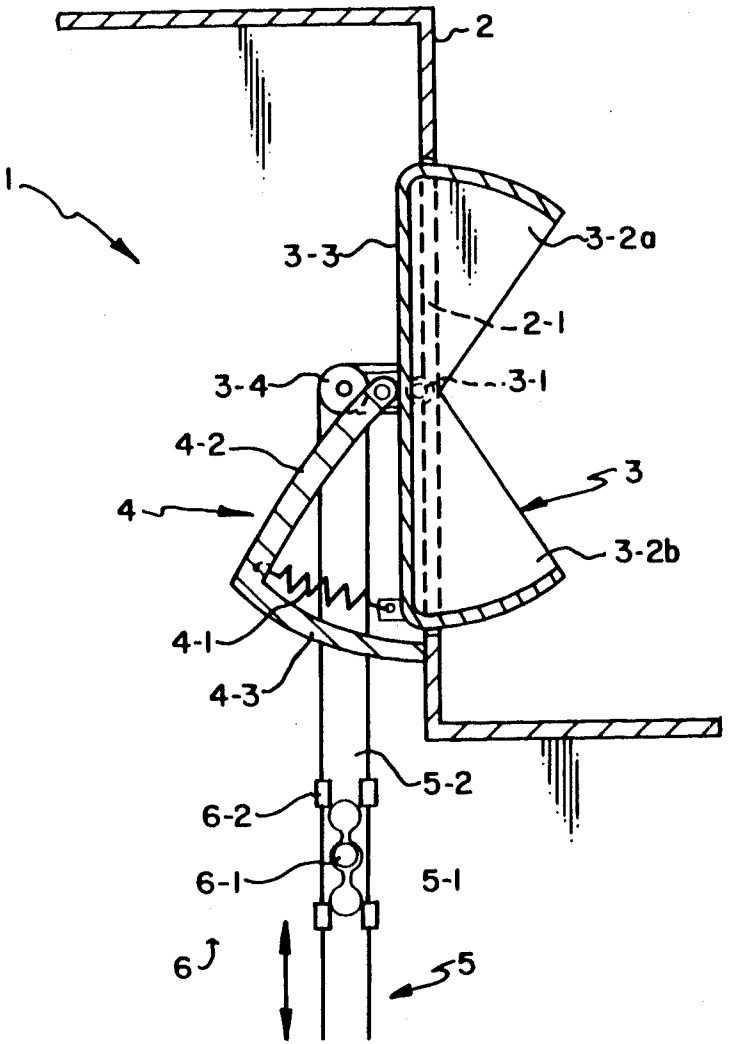
Figure 3C:
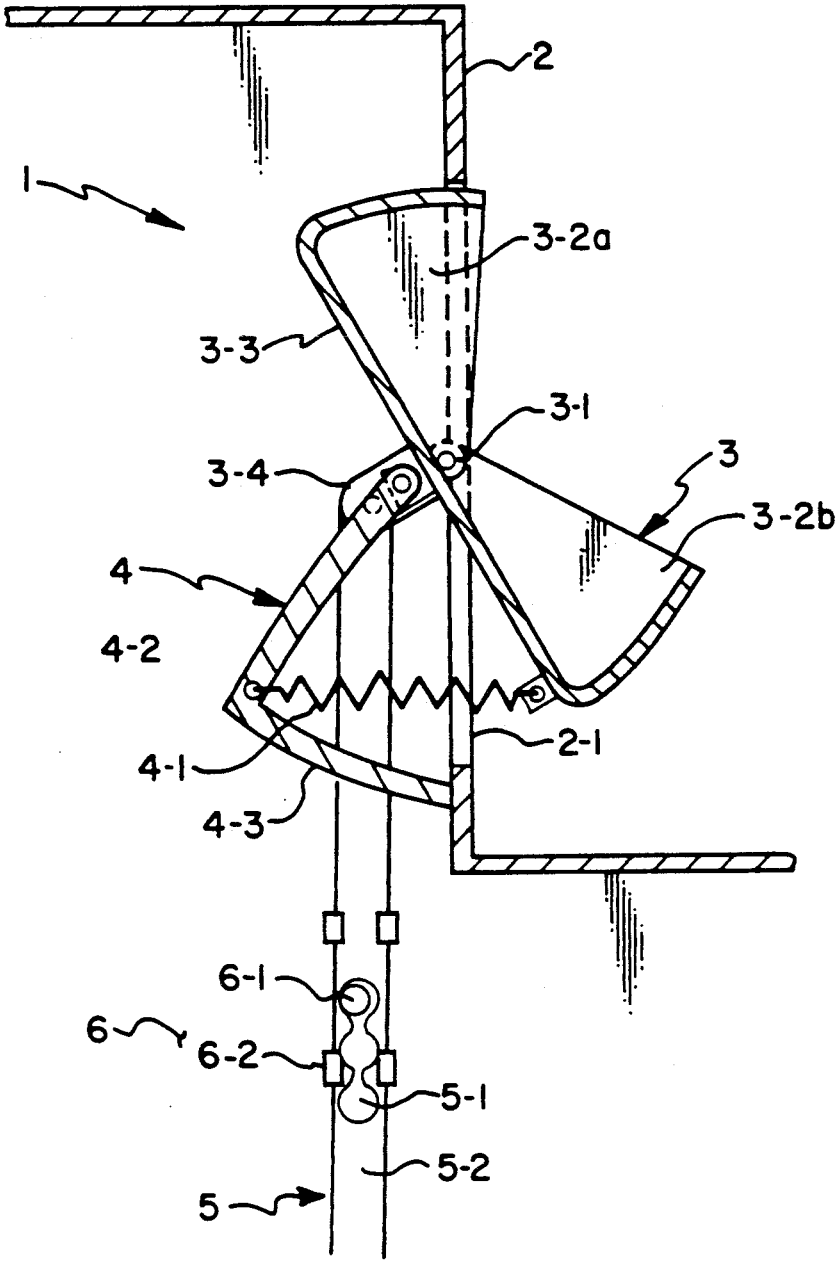

FIGS. 3A to 3C illustrate the ventilating means 1 in the first position for exhausting a proportion of the recirculated indoor air, the second position for introducing the fresh outdoor air and the third position for entirely closing the port.

When there is no need of ventilation or the air conditioner A, is in a stop mode, as shown in FIG. 3A, the body 3-3 of the throttling member 3 closes the port 2-1 entirely to isolate the indoor air from the outdoor air. At this time the sliding member 5-2 is maintained with the projection 6-1 of the bottom plate 6 of the inside section accepted in the middle recess 6-1.

In the condition that the indoor air recirculated by the air conditioner A should e ventilated, as shown in FIG. 3B, the grip 5-4 is manually pushed, so that the sliding member 5-2 moves inwardly to locate the projection 6-1 of the bottom plate 6 at the front recess 5-1 thereby causing the body 3-3, which is pivotally connected to the one end portion 5-3 by the connecting segment 3-4, to turn clockwise with an axis of the stud 8 in the center so as to open the port 2-1 by half.

Under this condition, a proportion of the indoor air blown by the blower 7 is exhausted from the opened half portion of the port 2-1. However, the other half portion of the port 2-1 is still closed by the part 3-2*b* of the body 3-3 since the movement of the body 3-3 is limited by the plate 4-2 which is maintained by the resilient member 4-1.

As shown in FIG. 3C, to introduce the fresh outdoor air into the recirculated indoor air, when the sliding member 5-2 moves outward by manually pulling the grip thereof to position the stud 8 in the rear recess 5-1, the body 3-3 is turned counterclockwise to open the half portion of the port 2-1 corresponding to the part 3-2*b* of the body. However, the plate 4-2 is maintained by the spacer 4-3 supported against the partition wall 2. The rotation of the body 3-3 is restrained by the resilient member 4-1 so that the part 3-2*a* closes the rear half portion of the port 2-1 while the front half portion is opened.

Accordingly, the recirculated indoor air stream blown by the blower 7 flows against the plate 4-2 into the room to be conditioned. At this time the pressure of recirculated air stream is reduced as compared with that of the outdoor ambient air according to the Bernoulli effect whereby the outdoor air is introduced into the recirculated air stream to be mixed.

According to the present invention, the ventilating means is capable of selectively exhausting a proportion of the recirculated indoor air and introducing a fresh outdoor air into the space to be conditioned and therefore, an air conditioning may be effectively obtained. Furthermore, the ventilating means has advantageous structure that may be readily manufactured and assembled.

While there has been described a preferred form of the invention, obviously modifications and variations may be made without departing from the spirit and scope of the following claims.

What I claim is:

1. In an air conditioner with ventilating means having a partition wall dividing a bulkhead of the air conditioner into the inside and outside section, a blower blowing the indoor air to be recirculated. said partition wall provided with a port communicating an outdoor air and said ventilating means comprising: throttle means provided at the port for selectively opening and closing a half of the port; air introducing means provided at the throttle means keeping apart from the partition wall for directing the recirculated indoor air stream to flow against it thereby causing the outdoor air to be introduced to the port; and an adjusting means connected to the throttle means for selectively positioning the throttle means between the open and close positions.

2. The air conditioner of claim 1, wherein said throttle means comprise a body consisting of two parts for opening the port by halves and closing it entirely; supporting means provided at the center portion of each of the bottom and top surfaces of the body to accept a stud through the aperture formed in the respective segments which are formed at the partition wall thereby pivotally supporting the body; and a segment formed at the lower end of the body for connecting said adjusting means to the body.

3. The air conditioner of claim 1, wherein said air introducing means comprise a plate of which the one end portion is provided with at least one resilient member and the other end portion is pivotally connected to the body; and a spacer integrally formed at the one end portion of the plate to keep the plate apart from the partition wall.

4. The air conditioner of claim 1, wherein said adjusting means comprises a sliding member having a series of recesses to accept a projection which is formed at the bottom plate of the inside section thereby positioning the sliding member to open the port by halves and close the port entirely; guiding members formed at the bottom plate of the inside section to guide the motion of the sliding member; and the one end portion of said sliding member being pivotally connected to the segment formed at the lower end of the body formed at the lower end of the body and the other end portion provided with a grip, which is extended from the front of the air conditioner.

* * * * *